US005205127A

United States Patent [19]

Agrawal

[11] Patent Number: 5,205,127

[45] Date of Patent: Apr. 27, 1993

[54] CRYOGENIC PROCESS FOR PRODUCING ULTRA HIGH PURITY NITROGEN

[75] Inventor: Rakesh Agrawal, Allentown, Pa.

[73] Assignee: Air Products and Chemicals, Inc., Allentown, Pa.

[21] Appl. No.: 750,332

[22] Filed: Aug. 27, 1991

Related U.S. Application Data

[63] Continuation-in-part of Ser. No. 638,483, Jan. 3, 1991, abandoned, which is a continuation-in-part of Ser. No. 563,012, Aug. 6, 1990, abandoned, which is a continuation-in-part of Ser. No. 562,878, Aug. 6, 1990, abandoned.

[51] Int. Cl.[5] ..... F25J 3/02

[52] U.S. Cl. ..... 62/24; 62/44

[58] Field of Search ..... 62/11, 13, 22, 24, 44

[56] References Cited

U.S. PATENT DOCUMENTS

| | | | |
|---|---|---|---|
| 3,886,758 | 6/1975 | Perrotin et al. | 62/13 |
| 4,137,056 | 1/1979 | Golovko | 62/22 |
| 4,783,210 | 11/1988 | Ayres et al. | 62/24 |
| 4,822,395 | 4/1989 | Cheung | 62/24 |
| 4,824,453 | 4/1989 | Rottman et al. | 62/22 |
| 4,902,321 | 2/1990 | Cheung | 62/24 |
| 4,957,523 | 9/1990 | Zarate et al. | 62/13 |

FOREIGN PATENT DOCUMENTS 376465 7/1990 European Pat. Off. .

*Primary Examiner*—Ronald C. Capossela

*Attorney, Agent, or Firm*—Russell L. Brewer; William F. Marsh; James C. Simmons

[57] ABSTRACT

This invention relates to a cryogenic process for the separation of air utilizing an integrated multi-column distillation system wherein an ultra high purity nitrogen product is generated. In the cryogenic distillation separation of air, air is initially compressed, pretreated and cooled for separation into its components. Ultra high purity, e.g., nitrogen having less than 0.1 ppm of light impurities is generated with enhanced nitrogen product recovery by withdrawing liquid nitrogen from a first column at an intermediate point and charging that fraction as feed to the second column, withdrawing a nitrogen stream which is rich in volatile contaminants from the top of the first column, partially condensing that nitrogen stream against crude liquid oxygen, and removing the uncondensed portion which has been concentrated in volatile contaminants as a purge stream. An ultra high purity nitrogen product is obtained from a second column.

8 Claims, 3 Drawing Sheets

CRYOGENIC PROCESS FOR PRODUCING ULTRA HIGH PURITY NITROGEN

CROSS REFERENCE TO RELATED APPLICATIONS

This application is a continuation-in-part of copending application entitled "CRYOGENIC PROCESS FOR PRODUCING ULTRA HIGH PURITY NITROGEN" having Ser. No. 07/638,483 and a filing date of Jan. 3, 1991 now abandoned which is a continuation-in-part of copending application entitled "CRYOGENIC PROCESS FOR PRODUCING ULTRA HIGH PURITY NITROGEN" having Ser. No. 07/563,012 and a filing date of Aug. 6, 1990 now abandoned which is a continuation-in-part application of copending application entitled "CRYOGENIC PROCESS FOR THE SEPARATION OF AIR TO PRODUCE ULTRA HIGH PURITY NITROGEN" having Ser. No. 07/562,878 and a filing date of Aug. 6, 1990 now abandoned. The subject matter of the related applications is incorporated by reference.

TECHNICAL FIELD OF THE INVENTION

This invention relates to a cryogenic process for the separation of air and recovering ultra high purity nitrogen with high nitrogen recovery.

BACKGROUND OF THE INVENTION

Numerous processes are known for the separation of air by cryogenic distillation into its constituent components. Typically, the air separation process involves removal of contaminant materials such as carbon dioxide and water from a compressed air stream prior to cooling to near its dew point. The cooled air then is cryogenically distilled in an integrated multi-column distillation system.

Processes to produce a high purity nitrogen stream containing few light contaminants, such as hydrogen, helium and neon have been proposed. Concentration of some of these contaminants in the feed air can be as high as 20 ppm. Almost all of these light components show up in final nitrogen product from an air separation unit (ASU). In some cases, such as for the electronic industry, this contamination level is unacceptable in the end use of this nitrogen product.

The following patents disclose approaches to the problem.

U.S. Pat. No. 4,824,453 discloses a process for producing ultra high purity oxygen as well as high purity nitrogen, where the nitrogen purity exceeds 99.998% and the amount of impurities is generally less than 10 ppm. More specifically, air is compressed, cooled and distilled in a rectification system wherein in a first stage rectification an oxygen enriched fraction is removed from the bottom and a nitrogen rich liquid fraction is removed from an upper portion of the first stage rectification, sub-cooled and returned as reflux to the top of the second stage rectification. A nitrogen rich liquid is removed from an upper portion of the second stage at a point just below an overhead removal point for nitrogen vapor from the second stage rectification. Liquid oxygen from the bottom of the first stage is sub-cooled, expanded and used to drive a boiler/condenser in the top of the high purity argon column. Nitrogen vapor from the top of the first stage is used to drive a reboiler/condenser in the bottom of a high purity oxygen column. To enhance product purity, a portion of the gaseous nitrogen stream from the top of the first column is removed as purge.

U.S. Pat. No. 4,902,321 discloses a process for producing ultra high purity nitrogen in a multi-column system. Air is compressed, cooled and charged to a first column where it is separated into its own components generating an oxygen liquid at the bottom and a nitrogen rich vapor at the top. The oxygen liquid is expanded and used to drive a boiler/condenser which is thermally linked to the top of the first column for condensing the nitrogen rich vapor. A portion of the nitrogen rich vapor is removed from the top of the first column and condensed in the tube side of a heat exchanger. The resulting liquid nitrogen is expanded and charged to a top of a stripping column wherein nitrogen including impurities are flashed from the stripping column. Any impurities not removed by flashing are stripped by passing a stream of substantially pure nitrogen upwardly through the column. The nitrogen liquid collected at the bottom of the stripping column is pumped to the shell side of the heat exchanger, vaporized against the nitrogen-rich vapor and removed as high purity product.

European Patent 0 0376 465 discloses an air separation process for producing ultra high purity nitrogen product. In the process, nitrogen product from a conventional air separation process is charged to the bottom of a column equipped with a reflux condenser. Liquid nitrogen is withdrawn from an upper portion of the column and flashed generating a liquid and a vapor. The liquid obtained after flashing is then flashed a second time and the resulting liquid recovered.

There are essentially two problems associated with the processes described for producing ultra-high purity nitrogen and these problems relate to the fact that in the '453 disclosure purities are quite often not sufficiently high to meet industry specifications and in the '321 process nitrogen recoveries are too low. The same can be said of the '465 European patent.

SUMMARY OF THE INVENTION

This invention relates to an air separation process for producing ultra high purity nitrogen as product with high nitrogen recovery. In the basic cryogenic process for the separation of air which comprises nitrogen, oxygen and volatile and condensible impurities in an integrated multi-column distillation system, an air stream is compressed, freed of condensible impurities and cryogenically distilled. Nitrogen is recovered as a product. The improvement for producing an ultra high purity nitrogen product in a multi-column distillation system comprising a first column and an ultra high purity nitrogen column which comprises:

a) generating a nitrogen rich vapor containing volatile impurities in an upper part of the first column and a crude liquid oxygen fraction in a lower part of said first column;

b) removing a fraction of said nitrogen rich vapor containing volatile impurities and at least partially condensing at least a portion of said stream thereby forming a first condensed fraction and an uncondensed fraction;

c) returning at least a portion of said first condensed fraction as reflux to a column in the distillation system;

d) removing at least a portion of the uncondensed nitrogen rich vapor fraction rich in volatile impurities generated in step b) as a purge stream;

e) generating a liquid nitrogen fraction in an upper part of said first column and removing said liquid nitrogen fraction from the first column;

f) introducing the liquid nitrogen fraction to an upper part of the ultra high purity nitrogen column as feed;

g) generating a nitrogen rich vapor fraction containing residual volatile impurities in the ultra high purity nitrogen column and removing that fraction as an overhead; and h) removing an ultra high purity nitrogen fraction from the ultra high purity nitrogen column.

There are several advantages associated with this process, those being the ability to produce nitrogen via a standard nitrogen generator plant with the resultant nitrogen being of ultra high purity and with high recovery of nitrogen based on feed air introduced to the process.

DRAWING

DETAILED DESCRIPTION OF THE INVENTION

Figure 1:
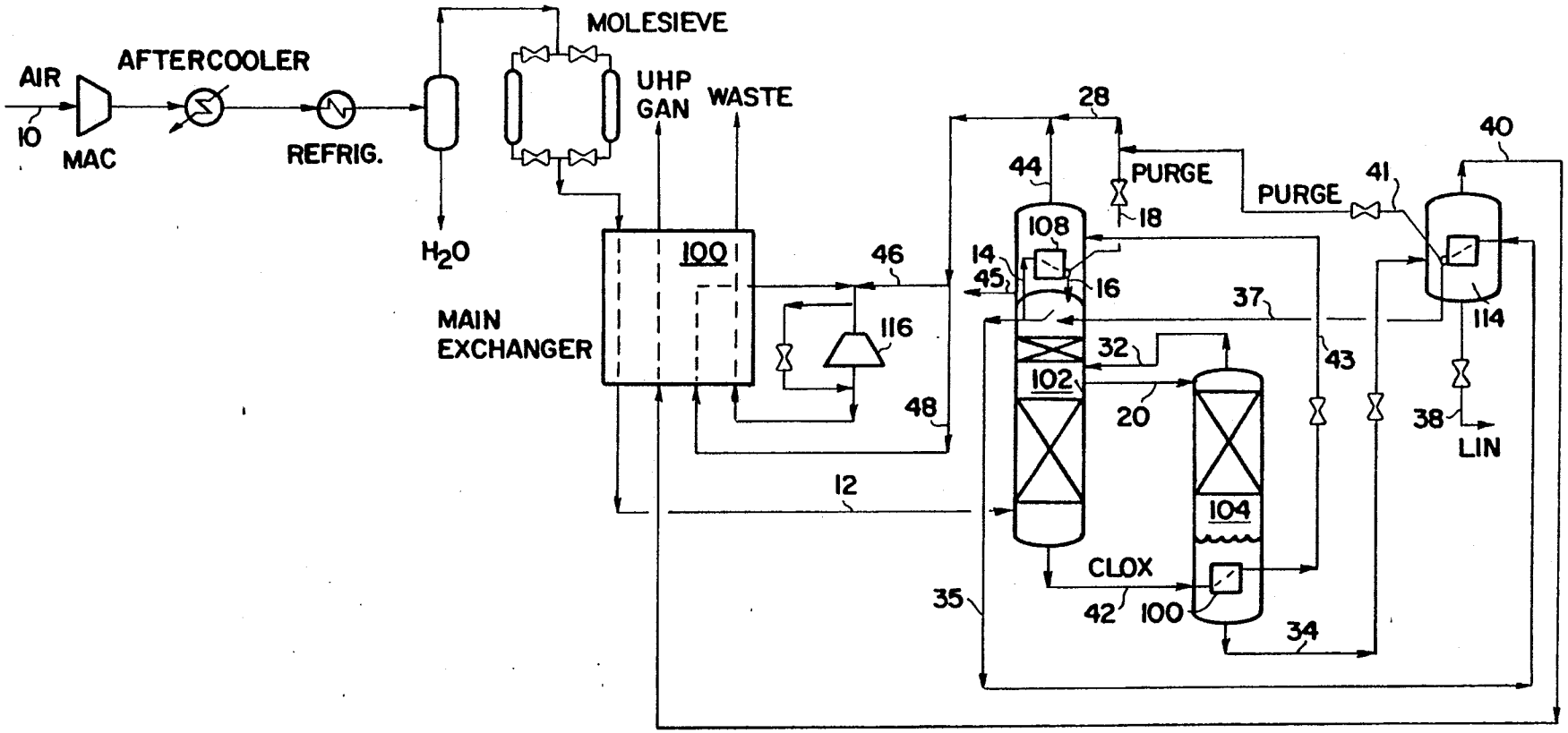
FIG. 1 is a schematic representation of an embodiment for generating ultra high purity nitrogen with enhanced nitrogen recovery.

To facilitate an understanding of the invention and the concepts for generating an ultra high purity nitrogen product having a volatile impurity content of less than 5 ppm and preferably less than 0.1 ppm, reference is made to the embodiment shown in FIG. 1. More particularly, a feed air stream 10 is initially prepared from an air stream by compressing an air stream comprising oxygen, nitrogen, argon, volatile impurities such as hydrogen, neon, helium, and the like, and condensible impurities, such as, carbon dioxide and water in a multi-stage compressor system (MAC) to a pressure ranging from about 70 to 300 psia. Volatile impurities have a much lower boiling point than nitrogen. This compressed air stream is cooled with cooling water and chilled against a refrigerant and then passed through a molecular sieve bed to free it of condensible water and carbon dioxide impurities.

The integrated multi-column distillation system comprises a first column 102 and an ultra high purity nitrogen column 104. Both columns 102 and 104 are operated at similar pressures and pressures which are close in pressure to that of the feed air stream 10, e.g., 70 to 300 psia, and typically from 90–150 psia. Air is separated into its components by intimate contact of the vapor and liquid in the first column 102. First column 102 is equipped with distillation trays or packing, either medium being suited for effecting liquid/vapor contact. A nitrogen vapor stream containing a high concentration of volatile impurities is generated at the top portion of first column 102 and a crude liquid oxygen stream is generated at the bottom of first column 102.

In the process an air stream 10 free of condensible impurities is cooled to near its dew point in main heat exchanger system 100. The air stream then forms the feed via stream 12 to first column 102 associated with the integrated multi-column distillation system. A nitrogen rich vapor containing volatile impurities is generated as an overhead and a crude liquid oxygen fraction as a bottoms fraction. At least a portion of the nitrogen vapor generated in first column is withdrawn via line 14 and partially condensed in boiler/condenser 108 located at the top of first column 102. Condensation of the nitrogen rich vapor containing light impurities concentrates these impurities in the uncondensed vapor phase. The condensed nitrogen, which has a fractional amount of impurities. is withdrawn from boiler/condenser 108 and at least a portion directed to the top of first column 102 as reflux via line 16. The uncondensed nitrogen vapor containing a large portion of the impurities is removed via line 18 as a purge.

In this embodiment a liquid nitrogen fraction is collected in an upper part of the first column, preferably at a point typically about 2–5 trays below the nitrogen removal point via line 14 in first column 102. That liquid nitrogen fraction is removed via line 20 and introduced to the top of ultra high purity nitrogen column 104 as feed and reflux. Ultra high purity nitrogen column 104 is operated within a pressure range from about 70–300, typically 90–150 psia, in order to produce an ultra high purity nitrogen product. The objective in the ultra high purity nitrogen column is to provide ultra high purity nitrogen. e.g., greater than 99.998% preferably 99.999% by volume purity at the bottom of the column. Ultra high purity nitrogen column 104 is equipped with vapor liquid contact medium which comprises distillation trays or packing.

It is in ultra high purity nitrogen column 104 where ultra high purity nitrogen is generated. The key to its success is the ultimate concentration and removal of a large part of the volatile impurities from a nitrogen vapor. More particularly, a nitrogen-rich stream containing residual volatile impurities is generated and removed from the top or upper most portion of ultra high purity nitrogen column 104 as an overhead via line 32 wherein it is returned to the upper to middle portion of first column 102. The concentration of residual volatile impurities in nitrogen vapor stream 32 is primarily controlled by the purge nitrogen stream removed from an upper portion of first column 102 as this governs the amount of volatiles submitted to the ultra high purity nitrogen column. An ultra high purity nitrogen product is generated as a liquid fraction (LIN) in the bottom portion of the ultra high purity nitrogen column 104 and removed via line 34.

The ultra high purity liquid nitrogen (stream 34) is vaporized by feeding it to a boiler/condenser 114 therein. The liquid stream is expanded through a valve and charged to the vaporizer side of the boiler/condenser 114. This vaporization of the liquid nitrogen at least partially condenses the nitrogen rich stream containing volatiles taken as an overhead from first column 102 via line 35. An ultra high purity nitrogen product is obtained as a liquid fraction from the boiler/condenser via line 38 and as a vapor fraction via line 40. The condensed fraction is returned to the first column 102 as reflux via line 37. If the nitrogen feed containing volatiles in line 35 is partially condensed in boiler/condenser 114, then the uncondensed portion is removed as a purge stream via line 41. This purge stream may be combined with purge stream 18 and discarded. Alternatively, the purge streams may be collected for the recovery of light contaminants helium, hydrogen and neon.

Oxygen is not a desired product in this nitrogen generating process. Crude liquid oxygen is removed from first column 102 as a bottoms fraction via line 42, cooled in boiler/condenser 110, expanded and then charged via line 43 to the vaporizer section of boiler/condensed 108 located at the top of first column 102. The vaporized portion of the oxygen is removed via line 44 as an overhead and the balance as a liquid purge via line 45. Some of the overhead is diverted to a turboexpander 116 via line 46 with the balance being warmed in main heat exchanger 100 and, then diverted to turboexpander 116. The exhaust from turboexpander 116 is warmed against process fluids in heat exchanger 100 and the discharged as waste. Optionally, a small fraction of the feed to turboexpander 116 may be diverted through an expansion valve and then discharged as waste.

Boilup at the bottom of the ultra high purity nitrogen column 104 is provided by cooling crude liquid oxygen 42 in the boiler/condenser 110. Alternatively, this boilup can be achieved by heat exchange with any suitable fluid. An example can be condensation of a portion of the feed air stream 12 in the boiler/condenser 110 to provide the boilup at the bottom of the ultra high purity nitrogen column 104. In this case, the condensed air stream will be returned to a suitable location in the first distillation column 102. Also, it is possible to use more than one fluid for heat exchange in the bottom boiler/condenser 110.

In FIG. 1, two purge streams 18 and 41 rich in light volatile impurities are shown, one from boiler/condenser 108 and one from boiler/condenser 114. However, it is not totally necessary to take purge from both of these boiler/condensers and any nitrogen rich stream containing volatiles may be totally condensed in any one of them. A purge stream from at least one of the boiler/condensers 108 or 114 is necessary but purge from both as shown FIG. 1 will decrease the concentration of volatiles in the feed to the ultra high purity nitrogen column 104. Further discussion of this feature is provided with respect to the description of the process shown in FIG. 3.

Even though not shown in FIG. 1, it is also possible to withdraw an ultra high purity gaseous nitrogen stream as product from the bottom of the ultra high purity nitrogen column 104. This route will be more attractive when only a fraction of the total nitrogen product is needed as an ultra high purity gaseous nitrogen. In such a case, most of the nitrogen product will be produced of standard purity from the top section of the first distillation column 102 and a gaseous ultra high purity nitrogen product from the bottom of the ultra high purity nitrogen column 104. The pressure of both the nitrogen products will be nearly identical. In this case, no ultra high purity liquid nitrogen stream 34 may be withdrawn from the bottom of the ultra high purity nitrogen column 104 to be vaporized in the boiler/condenser 114. Thus, for this case where only a fraction of the total nitrogen product is produced as ultra high purity nitrogen, boiler/condenser 114 may not be used.

Figure 2:
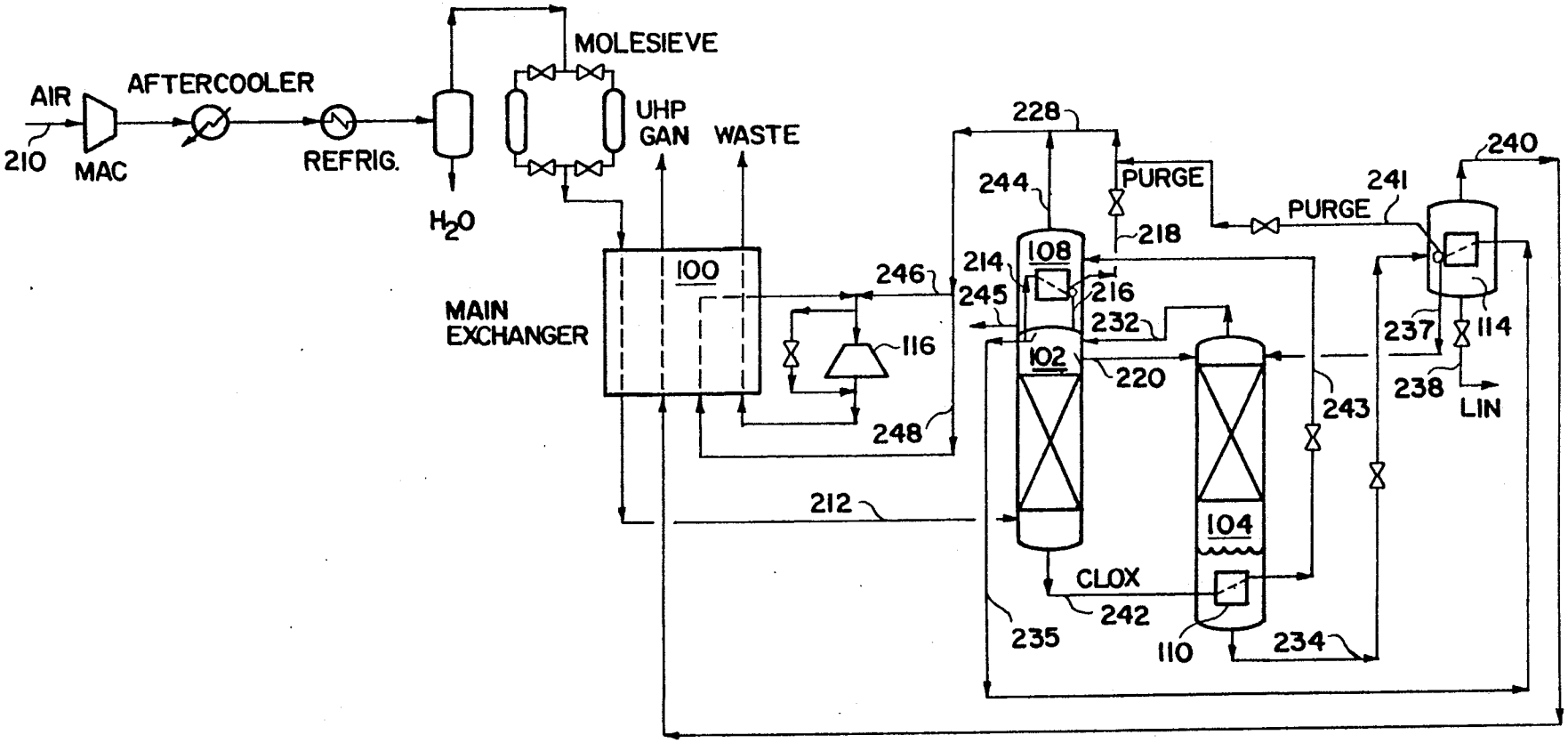
FIG. 2 is a schematic representation of an embodiment wherein nitrogen rich vapor and liquid are removed from the same location of the upper part of the first column.

D FIG. 2 provides a variation on the embodiment shown in FIG. 1. Equipment numbers utilized in FIG. 1 are utilized for the equipment in FIG. 2, line numbers have been renumbered using a 200 series. By and large the basic difference between the process of FIG. 1 and FIG. 2 is that the vapor fraction and liquid fraction withdrawn from an upper portion of first column 102 is essentially at the same location of the first column. Such process results in higher levels of impurities to be carried over with the nitrogen rich vapor fraction containing low boiling light volatile contaminants and with the liquid nitrogen from first column 102. By eliminating the trays in the upper part of the column, which trays were shown in FIG. 1, equipment costs can be reduced by eliminating the need for separate means to distribute reflux from boiler/condenser 108 and boiler/condenser 114 to the first column. Also by elimination of trays in the upper part of first column 102, one eliminates the associated pressure drop, although minimal, associated with such trays.

More specifically, the embodiment of FIG. 2 shows the removal of a nitrogen rich vapor stream containing light volatile contaminants via line 235 from first column 102 at a point above the trays in first column 102. As in the process described in FIG. 1 this stream is partially condensed in boiler/condenser 114 with the condensed fraction being returned to first column 102 via line 237 and the uncondensed fraction removed as a purge via line 241. Because of the increased concentration of light volatile impurities in the liquid feed to the ultra high purity column 104, either a higher boilup or greater number of theoretical stages of separation would be needed in this column for the same production rate of the ultra high purity nitrogen. All other functions of the process in FIG. 2 are similar to those functions described in the operation of process of FIG. 1 even though the 200 series of numbers is used.

In FIG. 2, the condensed nitrogen stream in Line 237 is directly fed to the ultra high purity nitrogen column 104 and the feed stream 220 is only a small liquid stream withdrawn from the top of the first column 102. This is equivalent to the withdrawal of a large liquid nitrogen stream 220 from the first column 102 and forming only a single feed to ultra high purity column 104.

Figure 3:
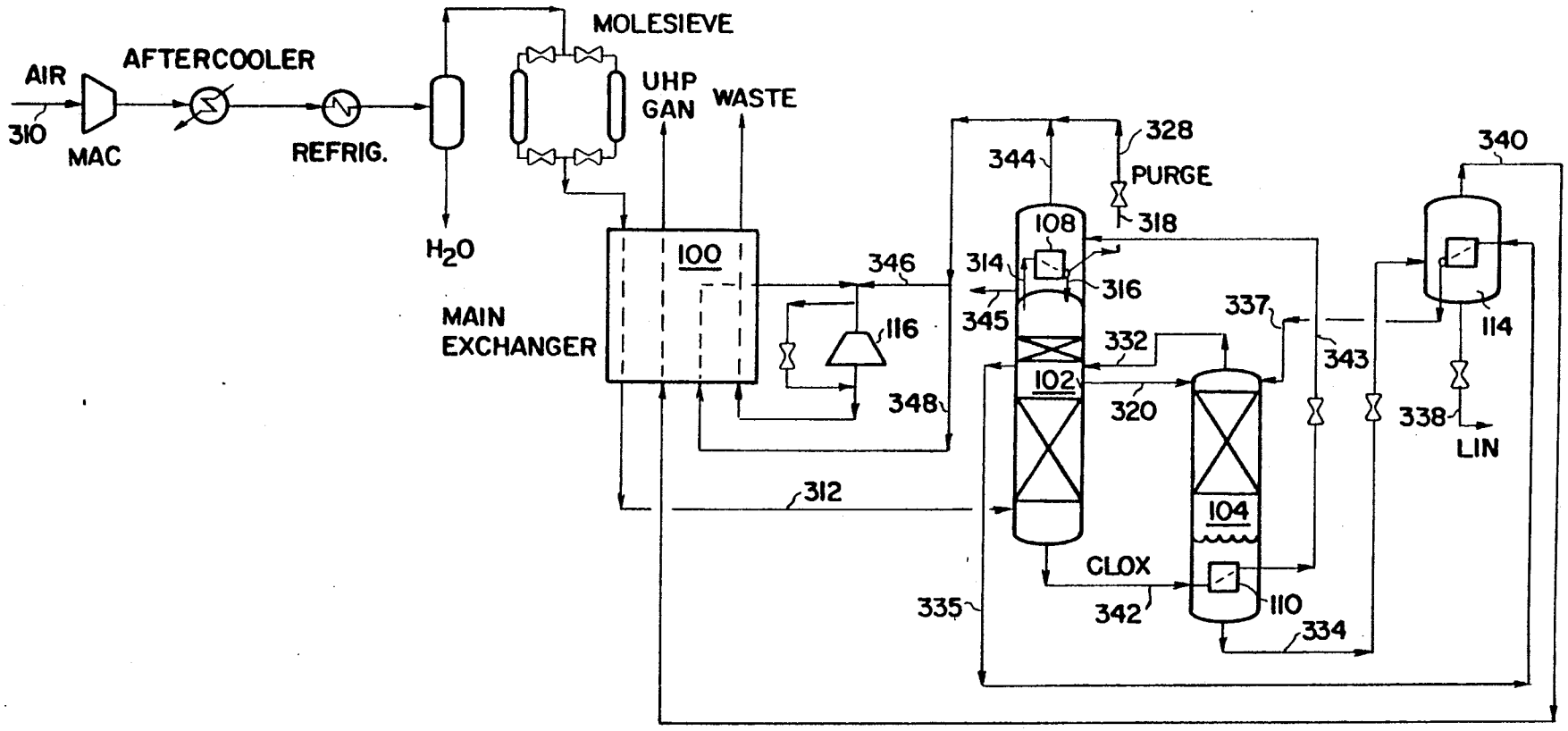
FIG. 3 is a schematic representation of an embodiment for producing ultra high purity employing the removal of a single purge.

FIG. 3 illustrates a variation of the embodiment of FIG. 1. Equipment designations used in FIG. 1 are used in FIG. 3 and stream functions have been designated using a 300 series to differentiate the process from FIG. 1. The embodiment in FIG. 3 utilizes a first column of similar design to that of FIG. 1 and it contains a major separation section followed by a top refining section for further concentration of the light volatile contaminants in the overhead fraction. In contrast to FIG. 1, the nitrogen rich stream containing volatile contaminants is removed via line 235 in an upper part of the first column at a point below the top refining section and charged to boiler/condenser 114. Substantially all of the nitrogen overhead fraction is condensed in boiler/condenser 114 and the condensed fraction is supplied as reflux to ultra high purity nitrogen column 104. No purge of any uncondensed fraction, if existent, is taken at this point. The return of the condensed fraction in line 337 to ultra high purity nitrogen column 104 is in contrast to the return of the condensed fraction from boiler/condenser 114 to first column 102 as described in FIG. 1. Similarly to the process of FIG. 1, a further refined nitrogen rich vapor stream having volatile light contaminants therein is withdrawn from an upper portion of first column 102 via line 314, partially condensed in boiler/condenser 108 with the condensed fraction being returned as reflux to first column 102 via line 316 and the uncondensed fraction removed via line 318. All other features of the process described in FIG. 3 are similar to those in FIG. 1. The basic operational difference between the embodiment of FIG. 3 from that of FIG. 1 is the reduction in a level of purge effected by this process. By taking purge only from boiler/condenser 108 the volume of purge may be substantially reduced from that process shown in FIG. 1 and therefore there is less loss of nitrogen by virtue of this process. In addition the embodiment permits the withdrawal of product nitrogen via line 340 at a higher pressure from that of FIG. 1. However, there may be a small penalty associated with the process in that ultra high purity nitrogen column 104 might require a few more trays to effect separation and concentration of the volatile light components in the overhead which is removed as an overhead via line 332. It is also worth noting that in FIG. 3, both liquid nitrogen streams to the ultra high purity nitrogen column 104 may not be fed to the same location. For example, while liquid stream 337 may be fed at the top, liquid stream 320 should be fed a couple of trays below the top.

Other functions in the process are similar to those in the process shown in FIG. 1, even though the 300 series of numbers has been utilized.

The following examples are provided to illustrate the embodiments of the invention and are not intended to restrict the scope thereof.

EXAMPLE 1

Ultra High Purity Liquid Nitrogen

An air separation process using the apparatus described in FIG. 1 was simulated. In this FIG., feed air stream 12 containing light contaminants is fed at the bottom of the first column. A gaseous nitrogen stream 14 is withdrawn from the top of first column 102 and is rich in volatile contaminants. A liquid nitrogen stream 20 is also withdrawn from about 2–5 trays below the nitrogen withdrawal point as feed and reflux to the ultra high purity nitrogen column 104. No major product streams are withdrawn from the top of the first column and the top 2-5 trays increase the concentration of the lights in the vapor phase. A non-condensible purge (stream 18) is taken from the boiler/condenser located at the top of the first column. This purge contains a fairly high concentration of the lights and is responsible for removing the majority of the light contaminants from the system. Alternatively, no purge need be taken and substantially all of the stream may be condensed and the volatiles allowed to concentrate for removal via line 41. These two streams are responsible for recovery in the process in the sense that the higher the flow rate the lower the recovery. However, because each stream is concentrated in lights, their volume may be maintained at a low level thereby enhancing recovery.

Sample calculations for the flowsheet in FIG. 1 were done for a preselected process design. The table sets forth the conditions:

TABLE

AIR SEPARATION FOR PRODUCING ULTRA HIGH PURITY NITROGEN PROCESS CONDITIONS FOR THE FIGURE

| Stream | Component | T °F. | P psia | F lb moles hr | Impurity Concentration He | $H_2$ | Ne |
|---|---|---|---|---|---|---|---|
| 12 | air | −269.9 | 126 | 100 | 5.2 ppm | 10 ppm | 18.2 ppm |
| 20 | $N_2$ | −277.6 | 122 | 41.1 | 0.05 ppm | 0.35 ppm | 0.58 ppm |
| 28 | purge | −279.9 | 122 | 0.05 | 1.04% | 1.97% | 3.58% |
| 32 | $N_2$ | −277.6 | 122 | 2.9 | 0.66 ppm | 4.96 ppm | 8.32 ppm |
| 34 | $N_2$ | −277.5 | 122 | 38.2 | <0.01 ppb | 0.05 ppb | 0.05 ppb |
| 35 | $N_2$ | 277.7 | 122 | 37.7 | 89 | 0.06% | 0.11% |

TABLE-continued

AIR SEPARATION FOR PRODUCING ULTRA HIGH PURITY NITROGEN PROCESS CONDITIONS FOR THE FIGURE

| Stream | Component | T °F. | P psia | F lb moles hr | Impurity Concentration He | $H_2$ | Ne |
|---|---|---|---|---|---|---|---|
| 40 | $N_2$ | −280 | 110 | 38.2 | ppm <0.01 ppb | 0.05 ppb | 0.05 ppb |

The process described in the figure results in high nitrogen recovery of ultra high purity product via line 38 and line 40 with an extremely low impurity level. Note the level of total contaminants is 0.11 ppb impurities.

What is claimed is:

1. In a process for the cryogenic separation of air which comprises nitrogen, oxygen and volatile impurities in an integrated multi-column distillation system wherein an air stream is compressed, freed of condensible impurities, and cooled generating a feed for the integrated multi-column distillation system, the improvement for producing an ultra high purity nitrogen product in a multi-column distillation system comprising a first column and an ultra high purity nitrogen column which comprises:

a) generating a nitrogen rich vapor containing volatile impurities in an upper part of the first column and a crude liquid oxygen fraction in a lower part of said first column;

b) removing a fraction of said nitrogen-rich vapor containing volatile impurities and at least partially condensing at least a portion of said stream thereby forming a first condensed fraction and an uncondensed fraction;

c) returning at least a portion of said first condensed fraction as reflux to a column in the distillation system;

d) a portion of the uncondensed nitrogen rich vapor fraction rich in volatile impurities generated in step b) as a purge stream;

e) generating a liquid nitrogen fraction in an upper part of said first column and removing said liquid nitrogen fraction from the first column;

f) introducing the liquid nitrogen fraction to an upper part of the ultra high purity nitrogen column as feed;

g) generating a nitrogen rich vapor fraction containing residual volatile impurities in the ultra high purity nitrogen column and removing that fraction as an overhead; and h) removing an ultra high purity nitrogen fraction from the ultra high purity nitrogen column.

2. The process of claim 1 wherein a portion of said nitrogen rich vapor fraction containing volatile impurities from the first column is at least partially condensed against crude liquid oxygen in a boiler/condenser located at the top of the first distillation column to provide a condensed fraction which is returned to the first distillation column as reflux.

3. The process of claim 2 wherein the liquid nitrogen from the ultra high purity nitrogen column is expanded and warmed against a fraction of the nitrogen rich vapor containing volatile impurities from the first column in a boiler/condenser thereby partially condensing a fraction of the nitrogen rich vapor, separating the condensed fraction from the uncondensed vapor fraction and removing the uncondensed vapor fraction as a purge stream.

4. The process of claim 3 wherein a liquid and vapor fraction are generated on the vapor side of the boiler/-condenser and at least a portion of the nitrogen liquid is recovered as product.

5. The process of claim 4 wherein at least a portion of the nitrogen vapor is recovered from the vapor side of the boiler/condenser as product.

6. The process of claim 2 wherein the condensed nitrogen rich vapor fraction reduced in volatile impurities is returned to the first column at an upper portion as reflux.

7. The process of claim 6 wherein crude liquid oxygen from the bottom of the first column is charged to a boiler/condenser in the bottom portion of the ultra high purity nitrogen column, cooled by indirect heat exchange, expanded and charged to the vaporizer side of the boiler/condenser located at the top of the first column.

8. In a process for the cryogenic separation of air which comprises nitrogen, oxygen and volatile impurities in an integrated multi-column distillation system wherein an air stream is compressed, freed of condensible impurities, and cooled generating a feed for the integrated multi-column distillation system, the improvement for producing an ultra high purity nitrogen product in a multi-column distillation system comprising a first column and an ultra high purity nitrogen column which comprises:

a) generating a nitrogen rich vapor containing volatile impurities near the top of the first column and a crude liquid oxygen fraction in the bottom of said first column;

b) removing and partially condensing at least a portion of said nitrogen rich vapor fraction containing volatile impurities thereby forming a first condensed fraction and an uncondensed fraction;

c) returning at least a portion of said first condensed fraction as reflux to a column in the distillation system;

d) removing at least a portion of the uncondensed nitrogen rich vapor fraction rich in volatile impurities generated in step b) as a purge stream e) removing a liquid nitrogen fraction from the first column at a point below the removal point for the nitrogen rich vapor containing volatile impurities from the first column;

f) introducing the liquid nitrogen fraction to an upper part of the ultra high purity nitrogen column as feed;

g) generating a nitrogen rich vapor fraction containing residual volatile impurities at the top of the ultra high purity nitrogen column and removing that fraction as an overhead; and h) removing an ultra high purity nitrogen fraction from the ultra high purity nitrogen column.

* * * * *